United States Patent [19]

Klaus

[11] 4,383,430

[45] May 17, 1983

[54] BENDING MACHINE

[75] Inventor: Siegfried Klaus, Ennepetal, Fed. Rep. of Germany

[73] Assignee: Rolf Peddinghaus, Ennepetal, Fed. Rep. of Germany

[21] Appl. No.: 218,407

[22] Filed: Dec. 19, 1980

[30] Foreign Application Priority Data

Dec. 22, 1979 [DE] Fed. Rep. of Germany ..... 2952026

[51] Int. Cl.[3] ..... B21D 7/02

[52] U.S. Cl. ..... 72/387; 72/319

[58] Field of Search ..... 72/387, 319, 310, 450, 72/313, 314, 315

[56] References Cited

U.S. PATENT DOCUMENTS

| | | | |
|---|---|---|---|
| 2,726,702 | 12/1955 | Laxo | 72/315 |
| 3,009,201 | 11/1961 | Hansen | 72/322 |
| 3,184,949 | 5/1965 | Olson | 72/310 |
| 3,479,855 | 11/1969 | Ogilvie | 72/385 |

FOREIGN PATENT DOCUMENTS

| | | |
|---|---|---|
| 1234177 | 9/1967 | Fed. Rep. of Germany . |
| 1283790 | 7/1969 | Fed. Rep. of Germany . |

*Primary Examiner*—Gene Crosby

*Attorney, Agent, or Firm*—Holman & Stern

[57] ABSTRACT

A bending machine for reinforcement mesh wires wherein the bending-rod which bends the wires around mandrels is supported by arms extending beneath the rest upon which the mesh is located in use. The bending-beam which carries the rod is driven in an arcuate path to perform the bending operation by means of cranks of adjustable eccentricity which co-act with a web member to which the beam is adjustably coupled. The components are so arranged that an imaginary line intersecting the crank axes is parallel to a similar line intersecting the bearings whereby the cranks are coupled to the web member.

8 Claims, 3 Drawing Figures

2
1
51
50
7
6
5
4
10
3
8
11
24
9
53
26
19
21
15
17
28
29
30
12
31
13
23
27
20
14
22
16
18
25
52

BENDING MACHINE

FIELD OF THE INVENTION

This invention relates to a bending machine for simultaneous bending of concrete reinforcement wires of constructional wire-mesh.

DESCRIPTION OF THE PRIOR ART

A bending machine of this type is known from German patent DE PS No. 12 34 177. The wire mesh is inserted into the machine with the cut ends upon a rest and extending beneath bending-mandrels, the bending-beam of the machine then being swung, during operation of the machine, so that the bending-rod associated with the beam simultaneously bends the cut ends of the mesh about the individual bending-mandrels. As the swinging movement of the bending-beam, and together with this the bending-rod, must occur eccentrically in relation to the axis of the bending-mandrels, the bending-rod moves in a relatively flat plane above the bending-mandrels, thus involving two disadvantages. Firstly the cut ends of the constructional steel mesh must be of a given minimum length in order to allow bending. On the other hand since those lengths are not required for eventual applications, the cut ends have to be cut back to the required size after bending, resulting in scrap and also involving additional work. Furthermore the extent of undesirable spring-back of the constructional steel mesh, which occurs after bending is determined in part by the distance by which the bending-rod forming the bending-tool has to be taken round the bending-mandrels. Thus the greater the bending-rod movement to achieve bending, the greater will be the extent of the undesirable spring-back.

BRIEF SUMMARY OF THE INVENTION

An object of the invention is to develop a bending machine of the type originally referred to, whereby said disadvantages can be avoided. For that purpose no space should be taken up above said rest of the machine by the bearing of the bending-beam and bending-rod, so that the constructional steel mesh may be freely pushed onto the rest then moved forwards, when the bending-beam, and together with it the bending-rod, are in their lower starting position. This arrangement is particularly important, since in this manner it is possible to design relatively wide bending-machines able to process correspondingly wide constructional steel mesh, without obstruction of the bending-rod by the bearings of the bending-beam. In addition this particular condition excludes any deflection of the bending-beam with frontal bearing means as a result of the increasing length due to the increased overall width of the machine, otherwise resulting in insufficiently accurate bending operations.

The requirements outlined above are fulfilled by the present invention. In accordance with the invention the bending-beam and more particularly the bending-rod are able to describe a movement concentric to the axis of the bending-mandrels. In this way the desideratum of exclusively short end bending is achieved, so that the undesirable spring-back is also kept to the lowest possible level.

Desirably, the eccentricity which exists between the crank-hub and the crank-pin, may be adjusted exactly to the distance between the bending-mandrels and the bending-rod plus the wire thickness. The bending-rod consequently in its starting position lies very closely adjacent the cut ends of the constructional steel mesh, and during the rotary movement which takes place in operation of the machine the radial distance of the bending-rod from the axis of the bending-mandrels does not vary, until the bending process is completed and the bending-rod is rotated back into its starting position.

Such an arrangement allows some particularly the use of bending-mandrels having differing bending diameters. The basic use of bending-mandrels having differing bending diameters is already known from the German Patent DE-PS No. 12 83 790. Nevertheless, this does not yet ensure the possibility of a concentric movement of the bending-rod in relation to the bending-mandrels axis. This becomes possible by means of a further feature of the present invention namely the feature that the eccentricity of both cranks is adjustable to the same extent as the bending-mandrels radius and the wire thickness. Insofar as the bending-rods must also have differing diameters, their radius must be correspondingly taken into consideration.

In order that it may be ensured that the bending-rod always bears against the processing material in the starting position, regardless of crank eccentricity, material thickness and bending-mandrel diameter, the distance by which a web of the machine engages with the bending-beam must be selected according to the relevant eccentricity and securing means at differing distances must be provided. In practice a particular arrangement has proved effective, whereby a spacer is secured to the bending-beam to guide the web within a fork which can be accurately adjusted for distance by means of a plug-in peg, the peg being capable of fitting various apertures in the web. In this way it is possible to achieve accurately reproducible degrees of eccentricity, when the crank-pin can be inserted in differing reception apertures of the crank corresponding with various levels of eccentricity. Differing reference numbers or the like may be used to indicate the diameter of individual bending-mandrels and material thicknesses, so that for instance in the transition to another bending-mandrel for material of the same thickness, the crank-pins and plug-in pegs of corresponding references may be inserted.

Regardless of such plug-in possibilities, corresponding continuous spindle adjustments allow infinite setting changes, which is particularly suitable for nonstandard bending-mandrel diameters or material thicknesses.

BRIEF DESCRIPTION OF THE DRAWINGS

An embodiment of the invention is will now be described in more detail with reference to the accompanying drawings, wherein.

DETAILED DESCRIPTION

Figure 1:
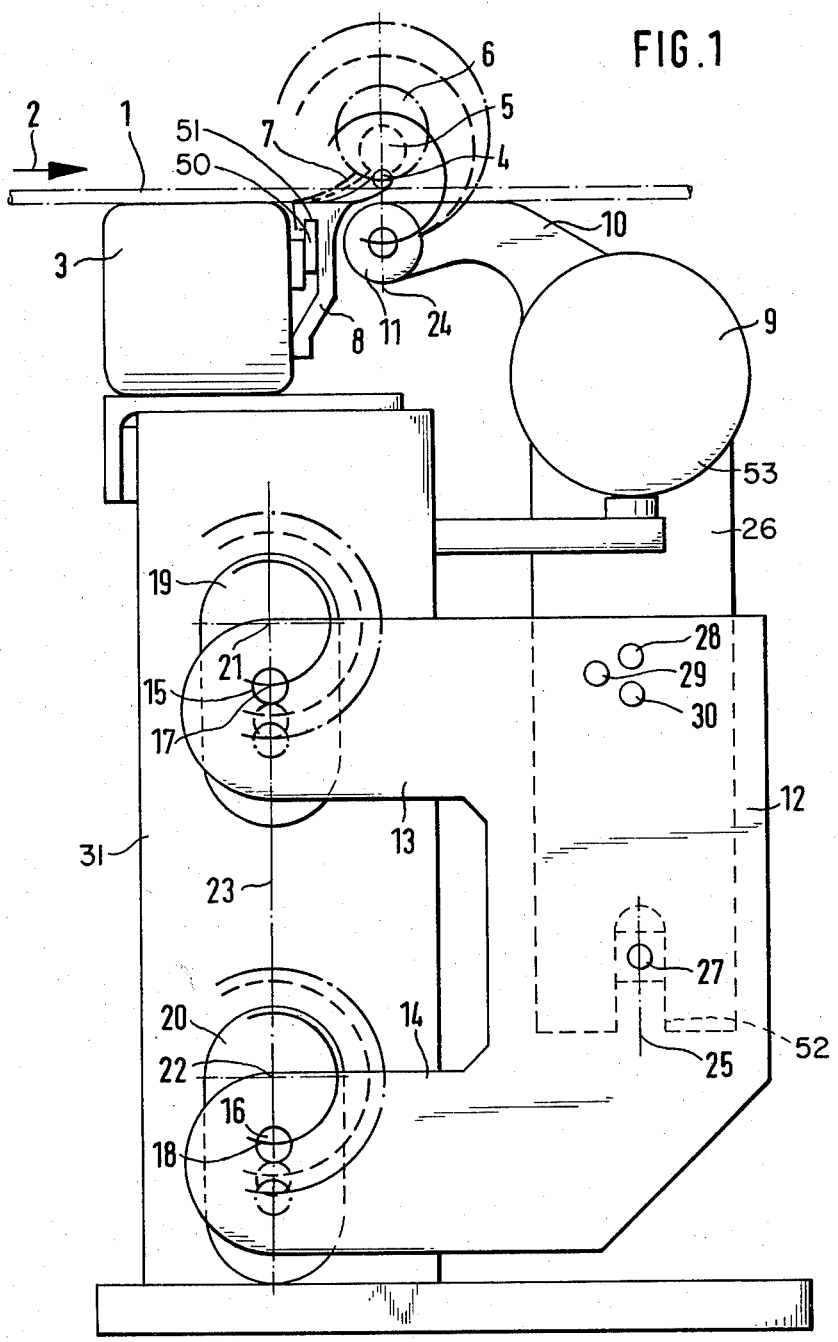
FIG. 1 is a side view of the bending machine of this invention showing the crank drive for the movement of the bending-rod.

As may be seen in FIG. 1, a constructional steel mesh wire 1 is pushed over a rest 3 in the direction of the arrow 2. The view shows one of a multiplicity of cut ends of a constructional steel mesh, which is not fully represented. The constructional steel mesh wire 1 is located on the rest 3 under a bending-mandrel 4 of relatively small diameter and indicated by the solid drawing line. Instead of this bending-mandrel 4 it is possible to use bending-mandrels of differing diameters. A further two bending mandrels 5 and 6 are shown in dash lines and dot-dash lines respectively. As the drawing also shows, the bending-mandrels may be arranged at differing heights, in order to accommodate constructional steel mesh wires of differing thicknesses. The mandrels are connected by means of holding-fingers 7 on shoes 8 which are mounted removably upon the rest 3 so that they can be exchanged for others as mentioned above.

This removable mounting is in the embodiment schematically shown, by way of illustration only, provided by a horizontal bar 50 mounted on the side of rest 3, such as by welding for example, and extending the desired length onto which the shoes 8 are engageable by means of notches 51 provided therein. This notch engagement together with the brace support by the lower end of shoes 8 against the side of rest 8 provide sufficient strength for the mandrels as well as interchangeability.

A bending-beam 9 carries a bending-rod 11 on crank arms 10, (shown in a starting position.) A modular bending-rod is also preferably used for differing bending-mandrels. As opposed to the bending-mandrels, which are only present at the constructional steel mesh wire transit points, the bending-rod 11 extends along the whole of the machine width, and is secured, in a predetermined spaced relationship to the bending beam 9 by means of the cranked arms 10, the bending-beam 9 also extending over the full width of the machine.

Figure 3:
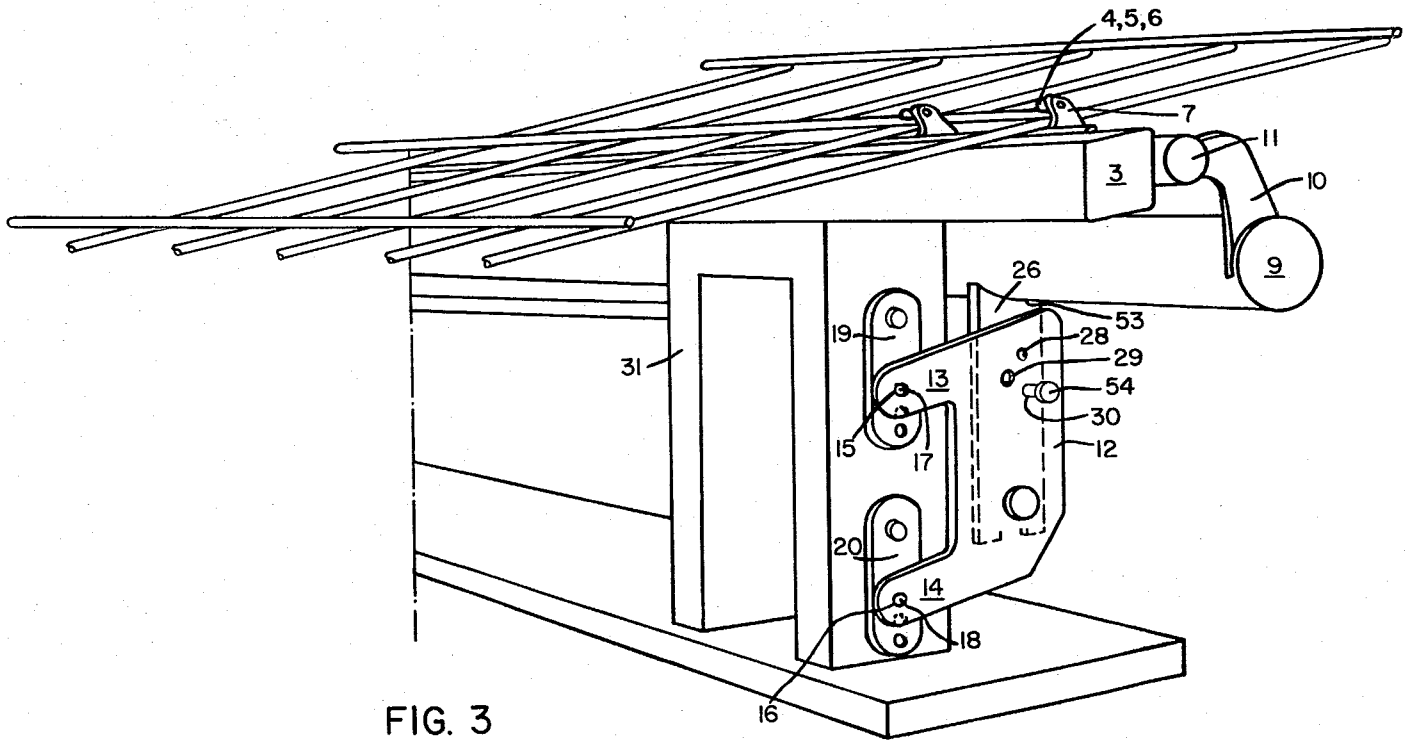
FIG. 3 is a perspective view of the bending machine as seen from the end shown in FIG. 1.

A web 12 is secured to the bending-beam 9, the web 12 having two arms 13 and 14 carrying end-bearings 15, 16 respectively. These bearings (schematically shown) receive eccentric stub shafts 17, 18 which may be adjustably mounted on cranks 19 and 20 at differing distances from the rotational axes 21, 22 of cranks 19, 20 respectively. FIG. 1 shows the crank eccentric shafts 17, 18 in the upper of three partly overlapping holes in each crank in which stub shafts 17, 18 are removably fitted. These holes may alternatively be spaced as shown in FIG. 3. In their positions at differing distances from the crank axes 21, 22, the shafts 17, 18 correspond with the differing distances between the axes of the bending-rod 11 and the bending-mandrels 4, 5 and 6 being used thus accommodating the thickness of the constructional steel mesh wire 1. As can be seen readily from FIG. 3, both cranks 19, 20 are driven synchronously and are located with their rotational axes 21, 22 intersecting a straight line 23, running parallel with straight line 24 which intersects the axes of bending-mandrels 4, 5 or 6 and the bending-rod 11. A further straight line 25 runs parallel with the lines 23 and 24 and forms the center-line of a slot 52 in the lower end of intermediate component 26, secured directly to the bending-beam 9 at the other end such as by welding at 53. In this way there is provided a slidable fork-guide for a block 27 which is carried on the web 12. The web 12 is secured to the component 26, at a point above the fork-guide, by means of a plug-in peg 54 insertable into one of three holes 28, 29 or 30 provided through web 12 and corresponding aligned holes (not shown) in component 26. These holes together with the slidable fork guide allow for adjustment of component 26, beam 9 and the bending rod 11 relative to web 12. The various securing possibilities correspond with the differing eccentricities of the stub shafts 17, 18 on cranks 19, 20 and also consequently with the various distances between the axes of bending-mandrels 4, 5 or 6 on the one hand and the bending rod 11 on the other hand.

As a result of this arrangement, the bending-rod 11, in use transcribes a circular movement, running concentrically about the center point of one of the bending-mandrels 4, 5 or 6. The mandrel 4, 5 or 6 about which the rod 11 moves is determined in accordance with the eccentricity chosen for the cranks 19, 20. The area of the arcs indicative of movement of the rod 11 are represented by the same symbol lines as the relevant bending-mandrels 4, 5 or 6.

Figure 2:
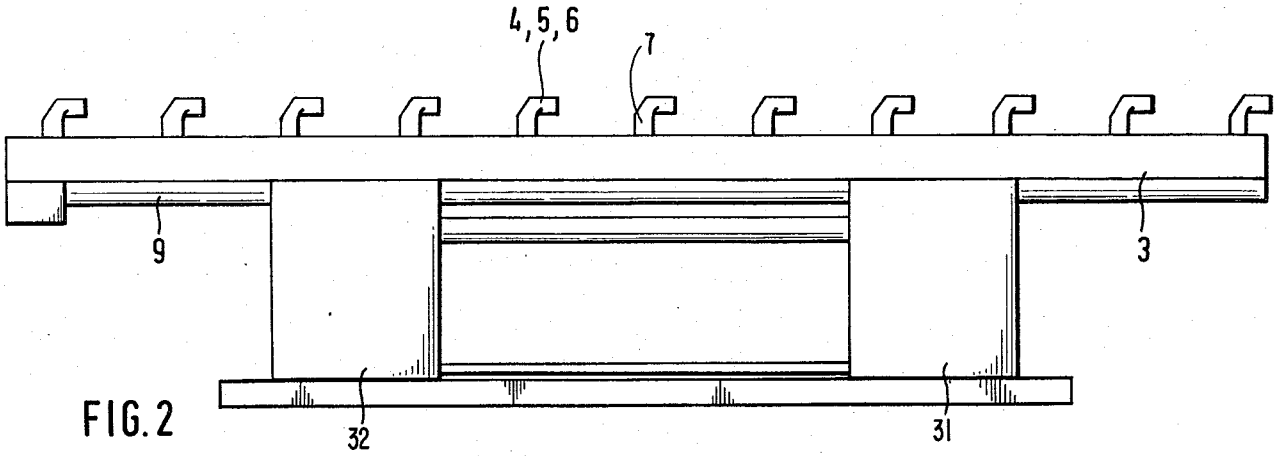
FIG. 2 is a front view of the overall bending machine as seen from the left side of FIG. 1, with certain parts omitted.

The front view of the overall bending machine shown in FIG. 2, shows the rest 3 running along the whole of the width of the machine, the bending mandrels 4, 5 and/or 6 being secured to the rest 3 spaced laterally from the constructional steel mesh wires, as will be noted in FIG. 1. The bending-beam 9 extends similarly beneath the rest 3 along the whole of the machine width, the bending-rod 11 being masked by the rest 3 in this view. The machine is supported on two spaced pillars 31, 32 each of which houses a crank device, of the type illustrated in FIG. 1 complete with gear-box (not shown), and to which a web 12 is connected as shown in FIG. 1. The webs 12 are coupled by means of intermediate components 26 the bending-beam 9 and thus are able to swing bending-beam 9 in such a manner that the bending-rod 11 in FIG. 1 transcribes a concentric movement in relation to the bending-mandrels during the bending operation. Components projecting sideways beyond the pillars 31, 32 clearly show that more favourable static conditions are achieved to support the rest 3 as well as the bending-beam 9, than when the rest 3 is supported at the ends and bending-beam 9 is held in bearings at both ends. Deflection of the rest 3 and beam 9 during a bending operation is greatly reduced, so that the components may be designed as somewhat lighter elements.

The crank drive and wire mesh in position on the machine are more clearly shown in FIG. 3, as well as the peg connector 54 for securing the relative positions between web 12 and each component 26. In the perspective left side view of FIG. 1, a cover plate, or door, has been removed from pillar 31.

In operation, in order to adjust the arc of movement of the bending-rod 11 with respect to the respective mandrel 4, 5, or 6 being used to accommodate different sized wires of the steel mesh, it is merely necessary to reset the stub shafts 17, 18 in the desired ones of alternate holes in each crank member 19, 20 and the peg 54 in the corresponding hole 28, 29 or 30.

Since the design according to the invention allows the cranks to transcribe precisely the same angular movement as the bending-rod, the required being angle position can be achieved in a more advantageous manner by means of a rotation position control, which can be located with a component on the hub of one of the cranks.

A particularly suitable arrangement is a potentiometer consisting of two parts moving in relation to each other, of which one part is placed on the hub, and the other part is secured in a location which is fixed in relation to the hub, so as to co-operate with the part placed on the hub, so as to provide an electrical resistance determined by the relative angular position of the two parts. With the aid of this resistance, it is possible to achieve the control of individually pre-set angles of rotation of the cranks and thus the bending rod, the angles being controlled by pre-setting a comparative resistance of a bridge. Such an arrangement provides programmed settings, useful in the event of more than one bending angle occurring in relation to the conventional steel mesh wires. Thus the use of a potentiometer provides a programme setting facility.

I claim:

1. A bending machine for simultaneous bending of the wires of a wire mesh comprising a base, a rest supported on said base for supporting the wire mesh, bending mandrels supported on said base adjacent said rest and around which the wires of the wire mesh are bent, a bending rod for bending said wires about said mandrels supported with respect to said rest and mandrels so that the wire mesh passes between the bending rod and mandrels when supported on said rest, a bending beam, at least one support arm connecting said bending rod to said beam, at least one web member connected to said beam, two spaced bearing holes in said web member, rotational shaft bearings mounted in said holes, said bearings being positioned with respect to said mandrels so that a first line passing through the centers of rotation of said bearings is substantially parallel to a second line passing through the centers of said mandrels and bending rod, two crank members rotatably mounted on said base and having their axes of rotation lying on a third line extending parallel to said second line, a crank shaft mounted eccentrically in each crank member and engageable in one of said bearings in said web member, and said crank members being adapted to driven to operate said bending rod through an arcuate path about said mandrels through said web member, beam and support arm.

2. A bending machine according to claim 7, wherein the eccentricity between the crank-axes and the crank shafts is substantially equal to the spacing between the centers of the bending-mandrels and the bending-rod.

3. A bending machine according to claim 2, wherein said bending-mandrels are removable and replaceable with mandrels having different bending diameters to accommodate wire mesh of varying size, and further comprising means to vary the eccentricity of said crank shafts to accommodate the different radii of the bending-mandrels and thickness of the mesh wire.

4. A bending machine according to claim 3, wherein an adjustable connecting means is provided between said web member and beam so that said web member is capable of being secured to said beam at various distances corresponding with the eccentricity of said crank shafts.

5. A bending machine as claimed in claim 4 wherein said means to vary the eccentricity of said crank shafts comprises a plurality of alternate holes for said crank shafts in each crank member, said holes in each crank member being at different radii, and said adjustable connecting means between the web member and beam comprises an intermediate component ridgedly attached to said beam, a slot in said intermediate component, a block supported on said web in slidable guiding relationship with said slot, a plurality of alignable holes through said web and said intermediate component so that said holes may be alternately aligned in a position corresponding to the respective eccentricity of the crank shafts, and a removable plug-in-peg for securing said aligned holes in fixed position.

6. A bending machine as claimed in claim 5 wherein the outer surface of said bending rod during the rest position before bending is substantially tangent to the plane of the surface of said rest on which the wire mesh is supported.

7. A bending machine as claimed in claim 6 wherein said beam is positioned during the rest position prior to bending on the same side of said plane as said bending rod and displaced from said plane.

8. A bending machine as claimed in claim 7 wherein said base comprises two spaced upstanding pillars, said rest extends between said pillars and beyond the outer extremities thereof, said bending rod and beam extend substantially the length of and parallel to said rest, and said mandrels are substantially evenly spaced along said rest to engage the adjacent wires being bent.

* * * * *